US007465220B1

(12) United States Patent
Wolff

(10) Patent No.: US 7,465,220 B1
(45) Date of Patent: Dec. 16, 2008

(54) APPARATUS AND METHOD FOR CORRUGATING RESHARPENED BLADES

(75) Inventor: David H. Wolff, Chesnee, SC (US)

(73) Assignee: Wolff Industries, Inc., Spartanburg, SC (US)

( * ) Notice: Subject to any disclaimer, the term of this patent is extended or adjusted under 35 U.S.C. 154(b) by 0 days.

(21) Appl. No.: 11/862,665

(22) Filed: Sep. 27, 2007

(51) Int. Cl.
*B24B 1/00* (2006.01)

(52) U.S. Cl. ..... 451/45; 451/178; 451/193; 451/234; 451/349; 76/82.2

(58) Field of Classification Search ..... 451/45, 451/178, 182, 193, 231, 234, 349, 358, 371; 76/82.2

See application file for complete search history.

(56) References Cited

U.S. PATENT DOCUMENTS

| | | | | | |
|---|---|---|---|---|---|
| 1,435,514 | A | * | 11/1922 | Burns | 451/45 |
| 1,911,974 | A | * | 5/1933 | Shelton | 451/45 |
| 4,265,055 | A | * | 5/1981 | Cartwright et al. | 451/45 |
| 4,450,653 | A | | 5/1984 | Fletcher | |
| 4,479,405 | A | * | 10/1984 | Junker | 76/38 |
| 4,528,778 | A | | 7/1985 | Wolff | |
| 4,607,459 | A | * | 8/1986 | Rees | 451/241 |
| 4,608,782 | A | * | 9/1986 | Chylinski | 451/45 |
| 4,627,194 | A | | 12/1986 | Friel | |
| 4,759,153 | A | * | 7/1988 | Cohen | 451/45 |
| 4,807,401 | A | * | 2/1989 | Atwater | 451/45 |
| 4,838,899 | A | | 6/1989 | Bifuk | |
| 4,841,678 | A | | 6/1989 | Thomas | |
| 5,175,962 | A | * | 1/1993 | Pedersen | 451/5 |
| 5,611,726 | A | | 3/1997 | Friel, Sr. et al. | |
| 6,012,971 | A | | 1/2000 | Friel, Sr. et al. | |
| 7,033,247 | B2 | * | 4/2006 | Zhang et al. | 451/5 |
| 7,235,004 | B2 | | 6/2007 | Friel, Sr. et al. | |
| 2002/0026713 | A1 | * | 3/2002 | Robert | 30/254 |

OTHER PUBLICATIONS

WS-CNC Series Brochure, American Siepmann Corporation, Copyright 2003.

* cited by examiner

*Primary Examiner*—Eileen P. Morgan
(74) *Attorney, Agent, or Firm*—Dority & Manning, P.A.

(57) ABSTRACT

An apparatus and method are provided for cutting corrugations into the resharpened blade of a scissor. The apparatus comprises a rotatable corrugating wheel. The peripheral annular circumferentially disposed edge of the wheel defines a corrugating surface that is configured to abrade the sharpened edge surface of the scissor blade. The corrugating surface is formed by a substantially uninterrupted ridge that helically winds around the entire circumferential edge of the corrugating wheel wherein adjacent windings of the ridge are separated by a substantially uninterrupted recess that helically winds around the entire circumferential edge of the corrugating wheel. The corrugating surface can be formed in the circumferentially disposed peripheral annular surface of a circular steel disc that has been coated with a fine diamond coating or a fine ceramic coating or a combination of the two. Alternatively, the corrugating surface can be formed in the circumferentially disposed peripheral annular surface of a circular disc formed of aluminum oxide.

17 Claims, 9 Drawing Sheets

APPARATUS AND METHOD FOR CORRUGATING RESHARPENED BLADES

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention pertains to devices for resharpening the dulled blades of handheld scissors and more particularly the corrugated blades of same.

Handheld corrugated scissors are used in many applications where the material is so slippery that it tends to slide along the edge of the blades when being cut by the scissors. The corrugations tend to prevent the material from sliding along the edge of the blade as the scissor is being used to cut the slippery material. For many applications, handheld scissors provide the most efficient and effective means of cutting materials. Many of these materials used in these applications are difficult to cut and tend to dull the blades of the scissors that are used to perform the cutting. Thus, to avoid discarding scissors with dull blades, a need exists for a device that resharpens the blades of the scissors. One example of such a device is disclosed in commonly owned U.S. Pat. No. 4,528,778 to Wolff, which is hereby incorporated herein in its entirety by this reference.

If the blade that needs resharpening has a corrugated blade surface, once the blade surface has been resharpened with a honing device, the resharpened edge loses the corrugations. In order to cut new corrugations into the resharpened edge, a file must be used by hand. This process of hand filing in order to provide the corrugations to the resharpened edge of the scissor's blade is tedious and time consuming and requires a certain amount of skill that must be learned by the filer.

Machines for manufacturing the corrugated blades of handheld scissors are known. At least one such serration and profile grinding machine is available from American Siepmann Corporation, 65 Pixley Industrial, Rochester, N.Y. Machines of this type typically employ a rotary grinding wheel that extends axially for substantially the entire length of the blade that is to be corrugated. Some such machines mill a sharp edge on the blade surface and simultaneously gouge out portions of the sharpened surface to form the corrugations along the blade edge. The corrugations in the grinding wheel are disposed in planes parallel to each other and normal to planes that contain the axis of rotation of the grinding wheel. In other machines the corrugations in the grinding wheel are disposed in planes parallel to each other and at an angle with respect to planes that contain the axis of rotation of the grinding wheel. However, the grinding wheels of such machines are expensive, and are prone to being damaged during use as well as prone to damaging the blade that is to be corrugated. Moreover, in some instances different wheels of different axial lengths must be mounted and dismounted to accommodate sharpening and corrugating blades of different lengths.

OBJECTS AND SUMMARY OF THE INVENTION

It is a principal object to provide an apparatus and method that replaces the hand filing method of reintroducing corrugations into the resharpened blade of a scissor.

It is another principal object to provide an apparatus and method that introduces a greater degree of automation into the process of cutting corrugations into the resharpened blade of a scissor and yet is more economical and more flexible in its application than prior art apparatus and methods.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus for corrugating a sharpened edge of a scissor blade comprises a rotatable corrugating wheel. The peripheral annular circumferentially disposed edge of the wheel defines a corrugating surface that is configured to abrade the sharpened edge surface of the scissor blade wherein any line taken in a direction parallel to the axis of rotation and across substantially the entire corrugating surface measures substantially less than the length of the blade of the scissors. Desirably, the entire corrugating surface measures less than one quarter of the length of the blade of the scissors that is to be corrugated. The apparatus includes a motor, desirably an electric motor, for driving rotation of the corrugating wheel. When viewed in a line across the peripheral, annular circumferentially disposed edge of the wheel, the corrugating surface can be viewed as being defined by a plurality of alternating grooves and sharp peaks, each groove/peak pair being spaced apart from the adjacent groove/peak pair.

In a presently preferred embodiment, each peak desirably is part of one long, substantially uninterrupted ridge that helically winds around the entire circumferential edge of the corrugating wheel like the thread of a metal screw. Similarly, each groove is part of one long, substantially uninterrupted recess that helically winds around the entire circumferential edge of the corrugating wheel. This pattern of a side-by-side ridge/recess pair is desirably ground into the entire circumferential edge of the corrugating wheel as would the threading of an exterior cylindrical surface. Thus, the corrugating surface is formed by a substantially uninterrupted ridge that helically winds multiple times around the entire circumferential edge of the corrugating wheel wherein adjacent windings of the ridge are separated by a substantially uninterrupted recess that helically winds around the entire circumferential edge of the corrugating wheel.

Alternatively, in a first alternative embodiment, the ridges in the corrugating surface of the corrugating wheel could be formed by the circumferential edges of planes disposed parallel to each other and normal to planes that contain the axis of rotation of the grinding wheel. In a still further alternative embodiment, the ridges in the corrugating surface of the corrugating wheel could be formed by the circumferential edges of planes disposed parallel to each other and disposed at an angle to planes that contain the axis of rotation of the corrugating wheel.

The pitch of the ridge/recess pattern is desirably in the range of about 48 ridges per inch to about 100 ridges per inch, and presently about 72 ridges per inch are deemed desirable.

The pitch is configured so that upon rotation of the corrugating wheel with the corrugating surface in contact with the edge of the resharpened blade near the portion of the blade closest to the pivot point of the scissor, the rotation of the wheel will result in translation of the blade from the portion of the blade closest to the pivot point of the scissor to the tip at the free end of the scissor blade. During this translation of the scissor blade by the rotation of the corrugating wheel, the corrugating surface of the corrugating wheel will grind new corrugations into the entire edge of the resharpened scissor blade. The speed of rotation of the corrugating wheel and the pitch of these groove/edge pairs desirably are chosen so that the user can grind a corrugated edge in a four inch scissor blade in less than about five seconds.

The corrugating surface can be formed in the circumferentially disposed peripheral annular surface of a circular steel disc that preferably has been coated with a fine diamond coating. In alternative embodiments, a fine ceramic coating or a fine silicon carbide coating or a combination of a fine coating of ceramic particles and/or diamond particles and/or silicon carbide particles can be used. Alternatively, the corrugating surface can be formed in the circumferentially disposed peripheral annular surface of a circular disc formed of aluminum oxide or in the circumferentially disposed peripheral annular surface of a circular disc formed of any other material hard enough to cut steel.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1A:
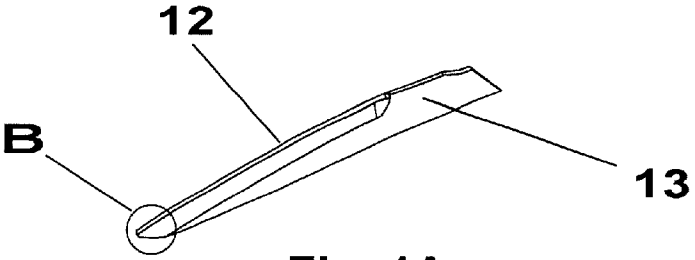
FIG. 1A is an elevated perspective view of a scissor blade.
Figure 1B:
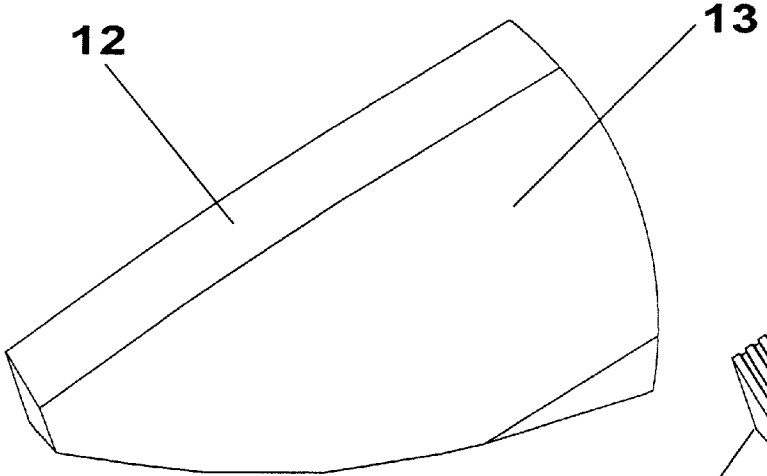
FIG. 1B is an elevated perspective view of a detail designated B in FIG. 1A.

FIG. 1A depicts a perspective view of a blade 13 of a scissor wherein the cutting edge 12 of the blade 13 has been recently sharpened or is a sharp blade 13 of a scissor. FIG. 1B shows a detail in the balloon designated B in FIG. 1A showing the cutting edge 12 of the scissor blade 13 as smooth as one would expect after a recently sharpened blade 13 as might be effected by the system disclosed in commonly owned U.S. Pat. No. 4,528,778, which is hereby incorporated herein its entirety for all purposes by this reference.

Figure 2A:
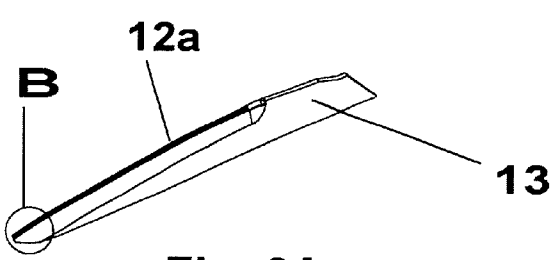
FIG. 2A is an elevated perspective view of a scissor blade with a corrugated cutting edge.
Figure 2B:
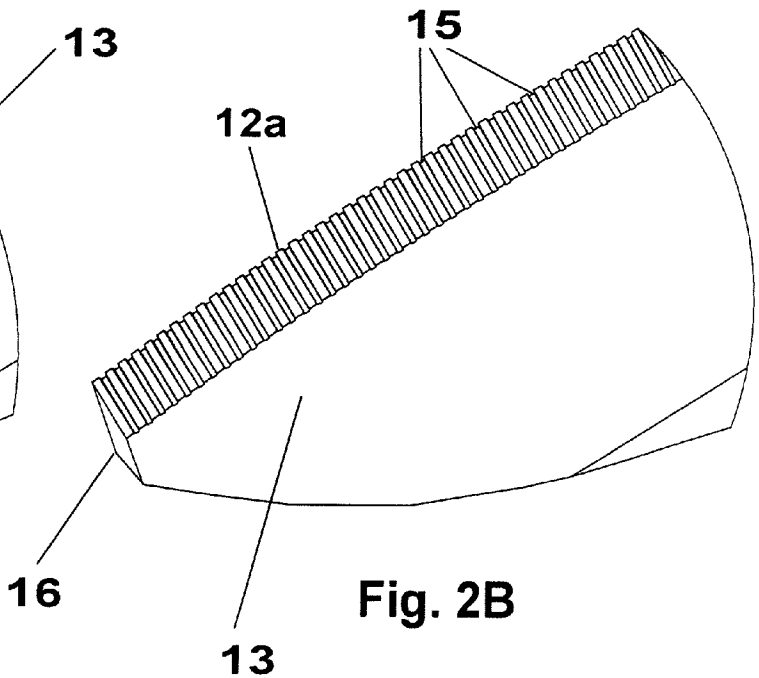
FIG. 2B is an elevated perspective view of a detail designated B in FIG. 2A.

FIG. 2A depicts an elevated perspective view of the blade 13 of a scissor wherein the blade 13 has a corrugated cutting edge 12*a*. FIG. 2B is a detail from the balloon designated B in FIG. 2A showing the corrugated cutting edge 12 comprising numerous scores 15 arranged parallel down the length of the blade 13 to the blade's tip 16. FIGS. 1A, 1B, 2A and 2B are not drawn to scale, and FIG. 2B is drawn to show that the scores 15 are disposed at a slight angle with respect to the face of the blade 13 rather than being perfectly perpendicular to the blade's face.

Briefly speaking, the apparatus and a method of the present invention converts the cutting edge 12 shown in detail in FIG. 1B into the corrugated cutting edge 12*a* shown in detail in FIG. 2B.

Figure 3:
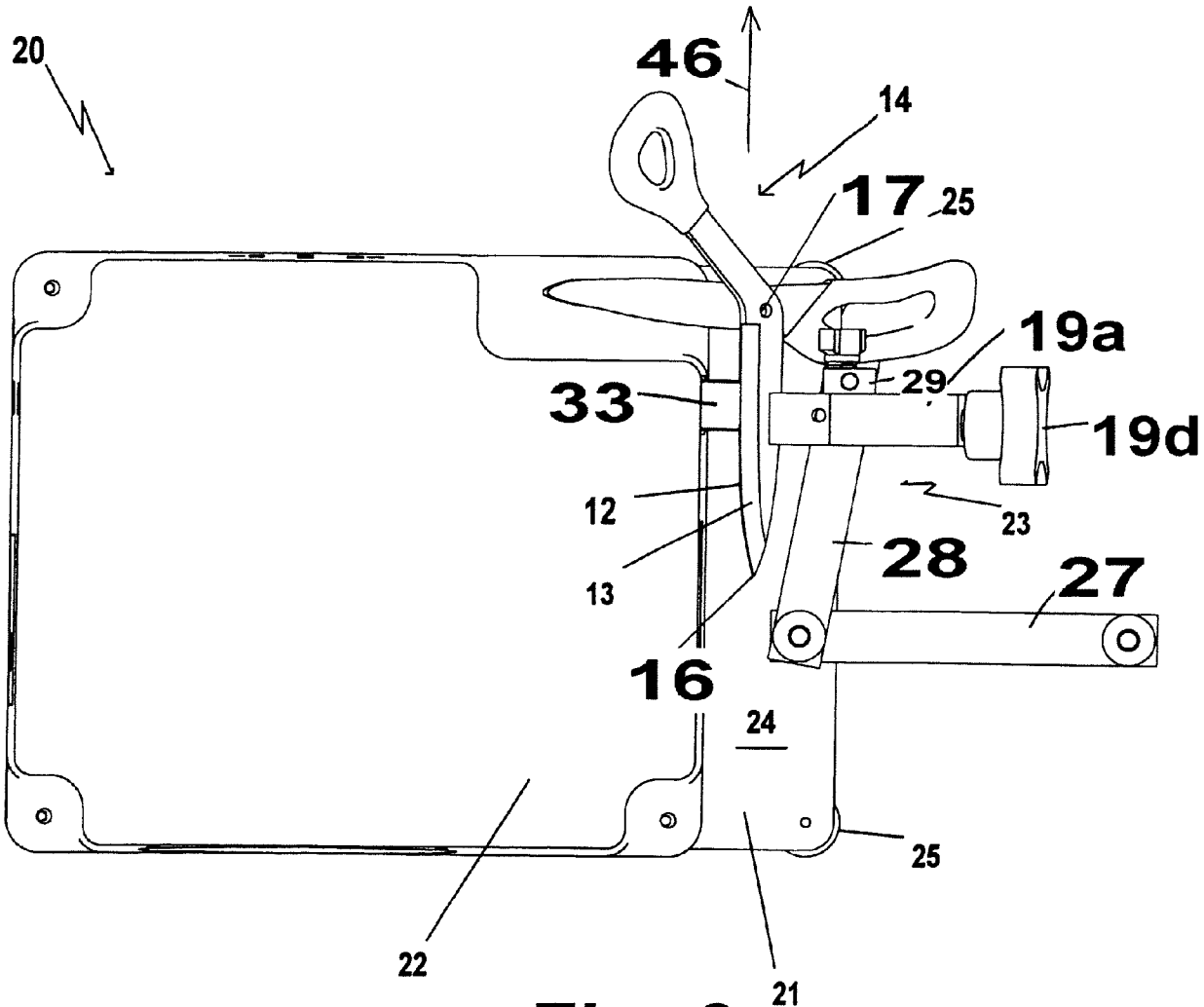
FIG. 3 is a top plan view of an embodiment of the apparatus of the present invention.

A presently preferred embodiment of the apparatus for grinding corrugations into the cutting edge 12 of a blade 13 of a pair of scissors 14 for which the cutting edge 12 of the scissor blade 13 has been resharpened is shown in a plan view from above in FIG. 3 and is represented generally by the numeral 20. The apparatus 20 includes a base 21 that desirably is formed of a flat, planar rigid plate such as a steel plate. The apparatus 20 further includes a rigid cover 22 that is carried by the base 21 and that desirably is formed of a rigid plastic such as polycarbonate and/or carbon composite and/or fiberglass composite.

Figure 9:
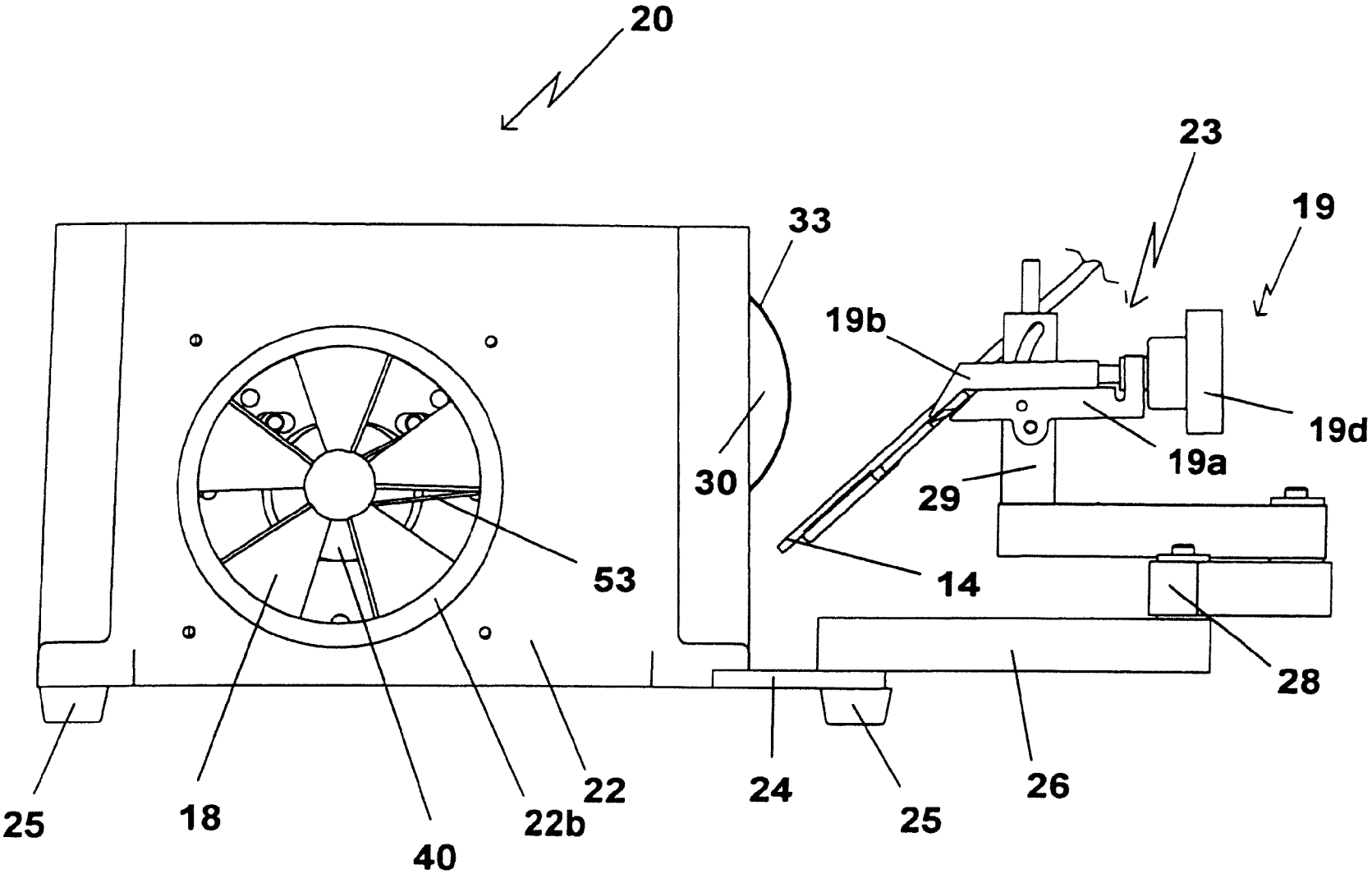
FIG. 9 is a side plan view of the embodiment shown in FIG. 3.

The proper orientation of the scissor blade's edge 12 that is to be corrugated desirably can be maintained by a clamping system, which is represented generally by the numeral 23 in FIG. 3 and desirably can be formed in the same manner as the system disclosed in commonly owned U.S. Pat. No. 4,528,778. Briefly, as schematically shown in FIG. 9, this clamping system 23 desirably can comprise an arm arrangement including a plurality of pivotally connected links 26, 27, 28 and 29. A first end of the lower link 26 of the arm arrangement can be carried by and desirably pivotally connected to the front shelf portion 24 of the base 21, which is the portion of the base 21 that is not hooded by the cover 22. As schematically shown in FIG. 9, a second end of the vertical link 29 of the arm arrangement can be pivotally connected to an adjustable blade holder 19, which can include an adjustable clamp having an upper jaw 19*a* opposed to a lower jaw 19*b* that can be adjusted by a connecting screw 19*c* rotatable by a knob 19*d*.

Figure 4:
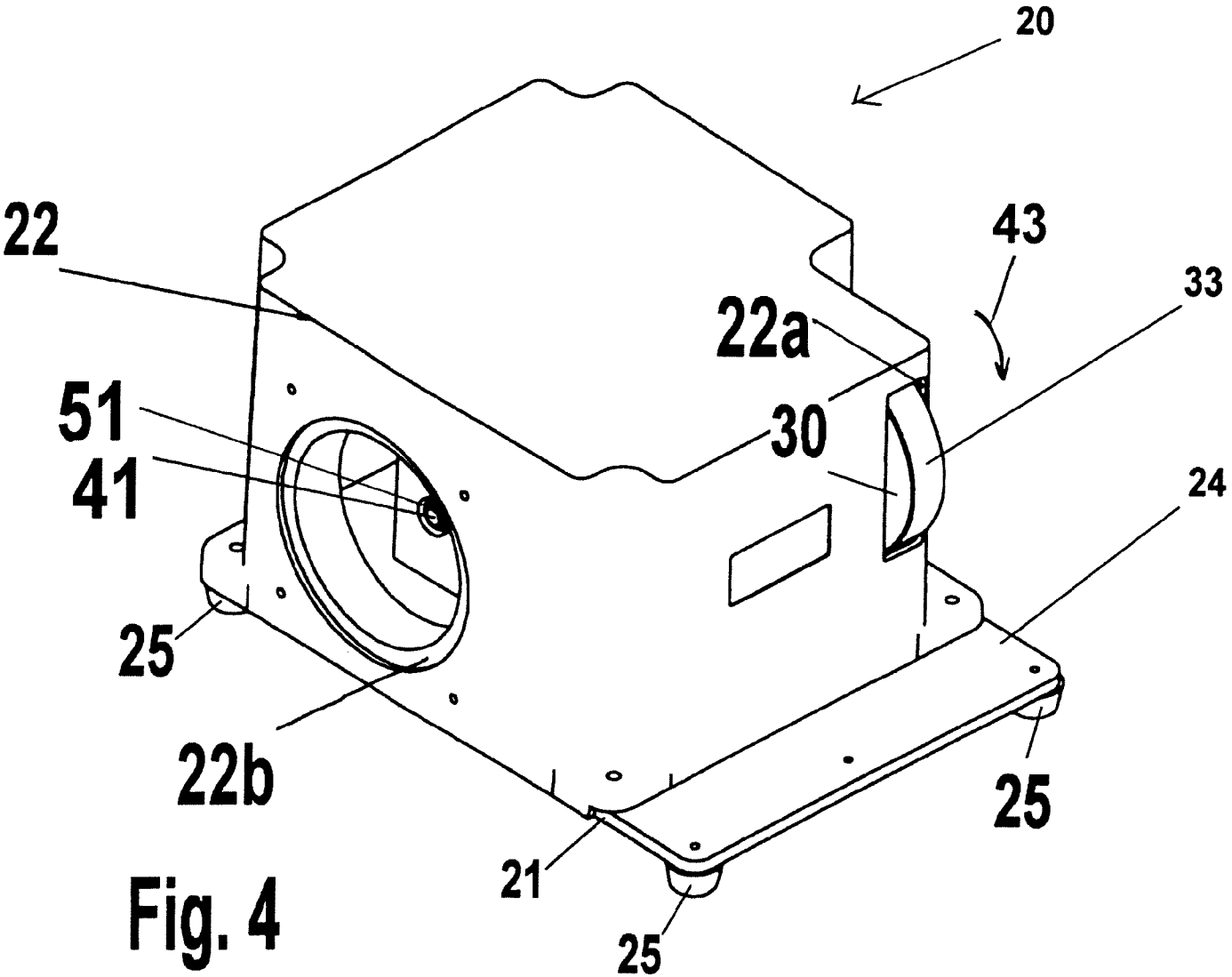
FIG. 4 is an elevated perspective view of an embodiment of components of an apparatus in accordance with the present invention.

FIG. 4 is an elevated perspective view of the apparatus 20 but with the clamping system 23 removed from its mounting on the front shelf portion 24 of the base 21, which desirably can be elevated above its resting surface by a plurality of feet 25. The feet 25 desirably can be formed of rubber or other comparable material, which desirably resists sliding on the surface on which the feet 25 rest. As shown in FIG. 4, the cover 22 defines a slotted opening 22*a* through which a small portion of a corrugating wheel 30 protrudes from within the cover 22. The cover 22 further defines a large circular opening 22*b* for discharging the exhaust flow of a cooling fan (not shown in FIG. 4).

Figure 5:
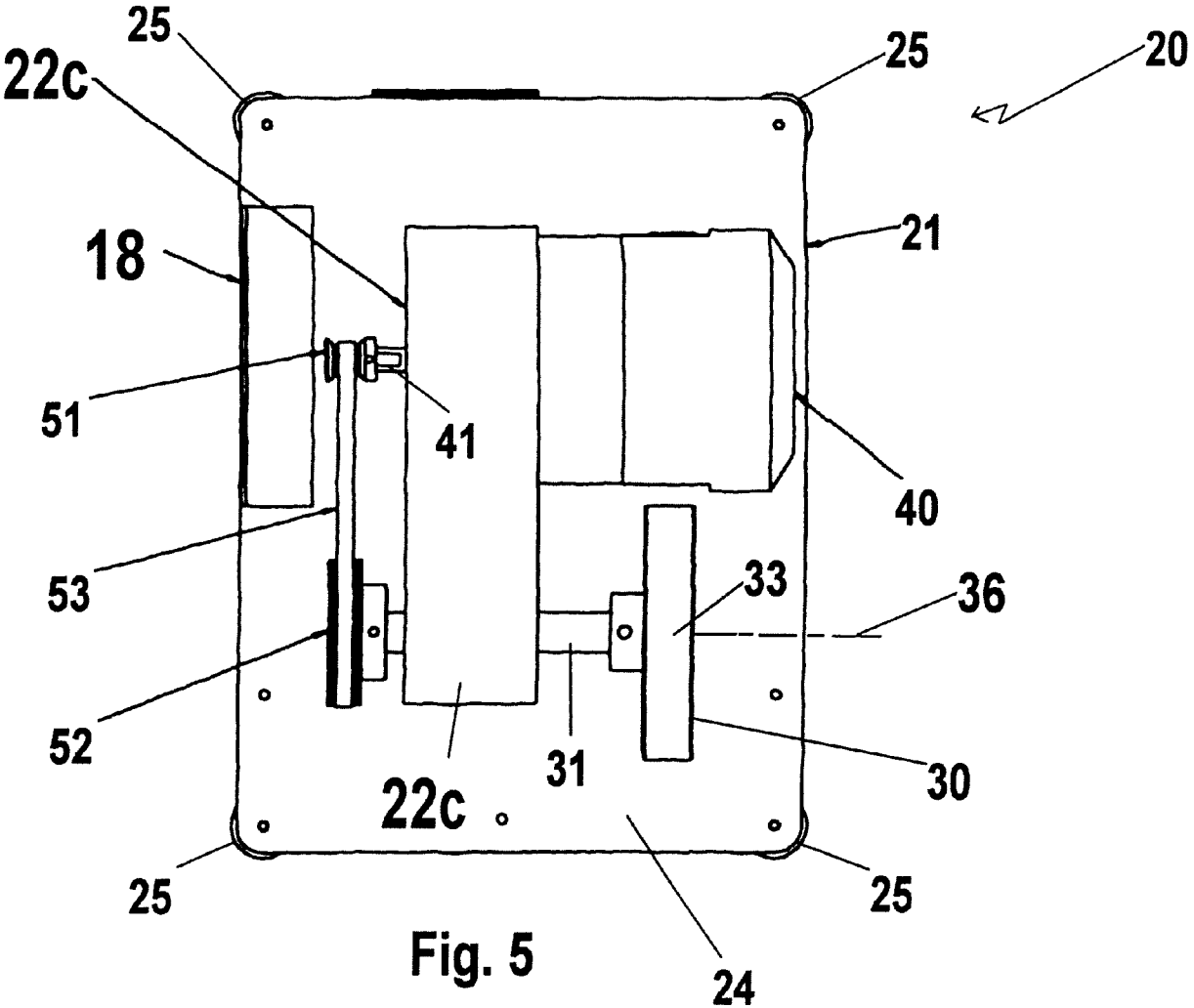
FIG. 5 is a top plan view of components of an embodiment of an apparatus in accordance with the present invention.

FIG. 5 is a top plan view of the apparatus 20 but with the cover removed in addition to removal of the clamping system. As schematically shown in FIG. 5, the apparatus 20 further includes the corrugating wheel 30, an axial shaft 31 carried by the base 21 and nonrotatably connected to the corrugating wheel 30 and having a central axis of rotation that is coincident with the axis of rotation 36 of the corrugating wheel 30. The apparatus 20 also includes a motor 40 having an armature 41 that is configured to be rotated by the motor 40 at a first revolution per minute (RPM) rating. As schematically shown in FIG. 10, the apparatus 20 desirably further can include a housing 22*c* for a bearing block (not shown in the view of FIG. 5).

Figure 10:
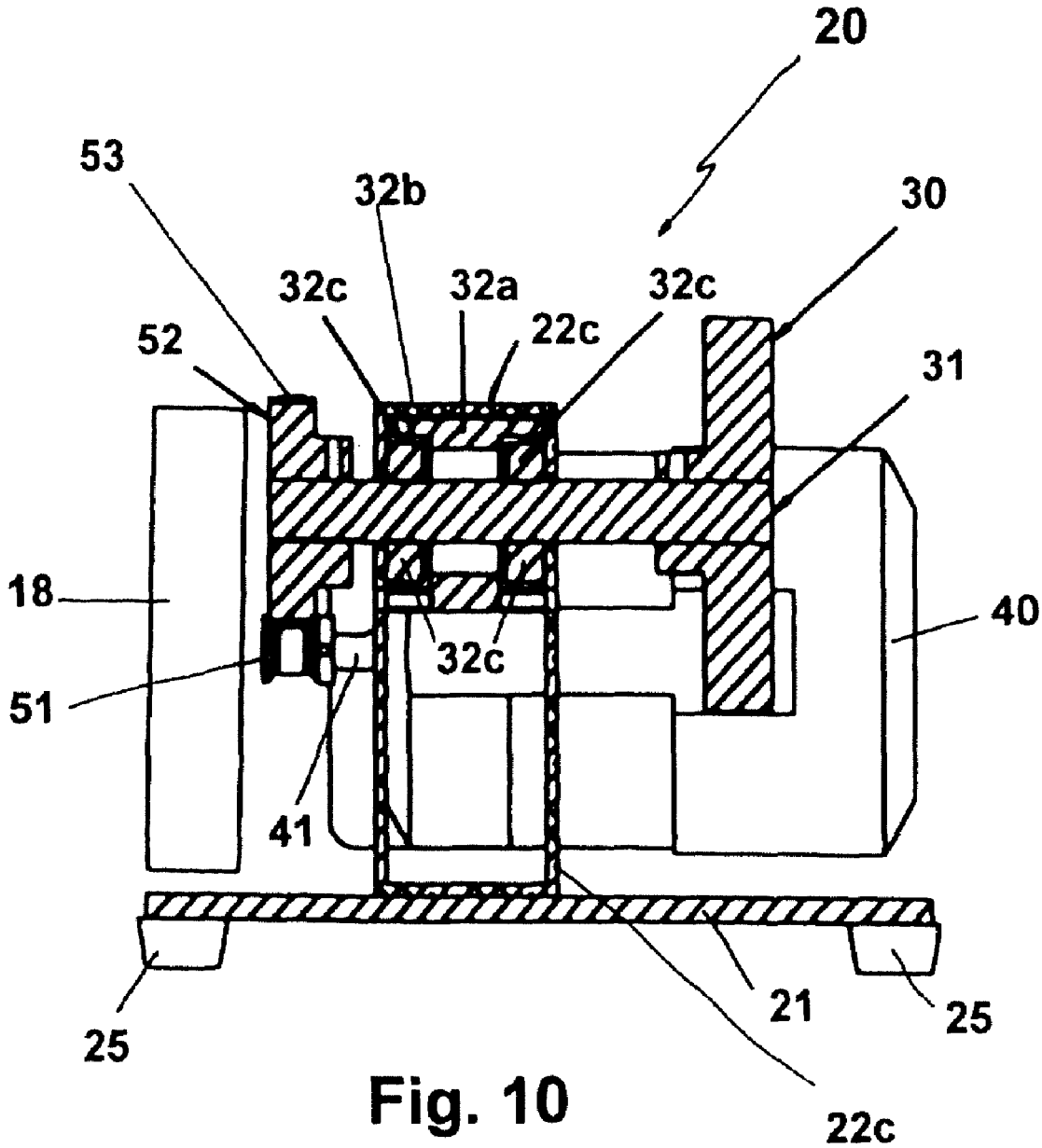
FIG. 10 is a cross-sectional view taken along the line of arrows A-A in FIG. 6.

As schematically shown in the partial cross-sectional view of FIG. 10, the housing 22*c* is carried by the base 21 and positions the bearing block 32*a* at the appropriate height for rotatably supporting the axial shaft 31. The housing 22*c* also shields the bearing block 32*a* from the grit generated during the grinding process performed by the apparatus 20. As schematically shown in FIG. 10, the bearing block 32*a* houses the bearing race 32*c*, which holds the bearings 32*c*, such as roller bearings or pillow bearings that rotatably support the axial shaft 31.

As schematically shown in FIGS. 5 and 10, the apparatus 20 further desirably includes an electric-powered cooling fan 18 and a gearing arrangement that desirably includes a first cogged pulley 51 that is non-rotatably connected to the armature 41 of the motor 40. The gearing arrangement also can include a second cogged pulley 52 that is nonrotatably connected to the axial shaft 31. As schematically shown in FIG. 5, the gearing arrangement is carried by the base 21 and connects the rotatable armature 41 of the motor 40 to the axial shaft 31 that is nonrotatably connected to the corrugating wheel 30. Accordingly, as schematically shown in FIGS. 5 and 6, the gearing arrangement also desirably can include a cogged drive belt 53 that positively engages each of the first cogged pulley 51 and the second cogged pulley 52 in a manner that permits the motor 40 to drive rotation of the axial shaft 31 that is connected to the corrugating wheel 30 and thus rotate the corrugating wheel 30.

Moreover, from FIGS. 4 and 5, it can be seen that the cover 22 can be configured to cover the cooling fan 18, the motor 40, the armature 41, the bearing block 22*c* and its contents, the axial shaft 31, the gearing arrangement, and all but a small portion of the corrugating wheel 30 that protrudes through the slot 22*a* of the cover 22.

Figure 6:
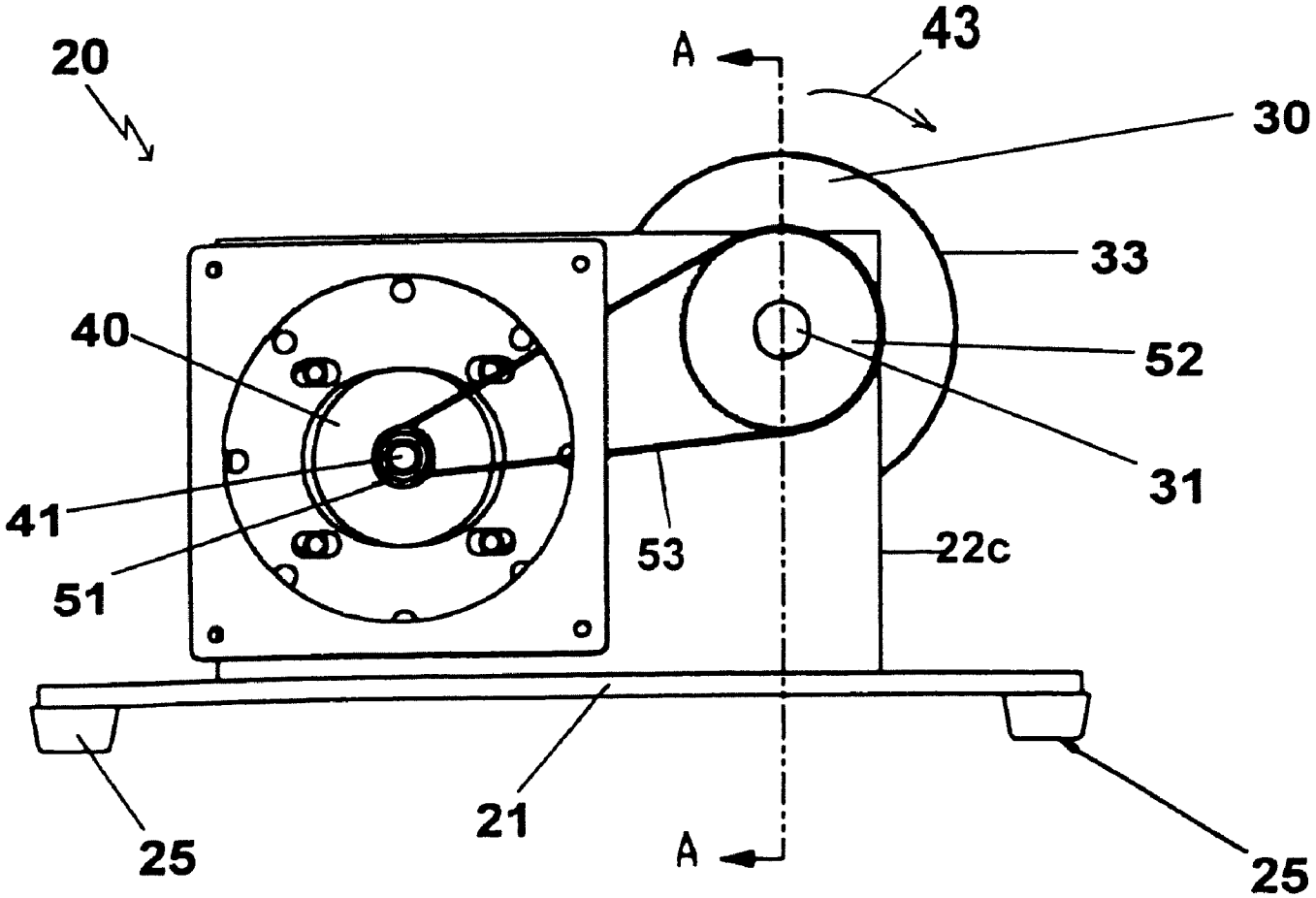
FIG. 6 is a side plan view of components of an embodiment of an apparatus in accordance with the present invention.

As schematically shown in FIG. 6, which is a side plan view of the apparatus 20 with the cover and clamping mechanism removed, the gearing arrangement is configured to convert the first RPM rating of the armature 41 of the motor 40 to a second RPM rating at the axial shaft 31 and hence at the corrugating surface 33 of the corrugating wheel 30. The second RPM rating is determined by the relative diameters between the first cogged pulley 51 and the second cogged pulley 52 as well as the first RPM rating of the armature 41 of the motor 40. Desirably, the second RPM rating is less than the first RPM rating.

In an exemplary embodiment, the motor 40 can be an electric motor that generates 1/15 horsepower at 1700 revolutions per minute operating at 110 volts. A suitable electric motor 40 that serves well for this purpose is available from Baldor Electric Company of Fort Smith, Ark. The motor 40 also can be adapted to operate at 240 volts. Desirably, the 1700 RPM of the armature 41 of the motor 40 is converted by the cogged drive belt 53 and cogged pulleys 51, 52 to rotate the axial shaft 31 of the corrugating wheel 30 at about 400 RPM.

Figure 7:
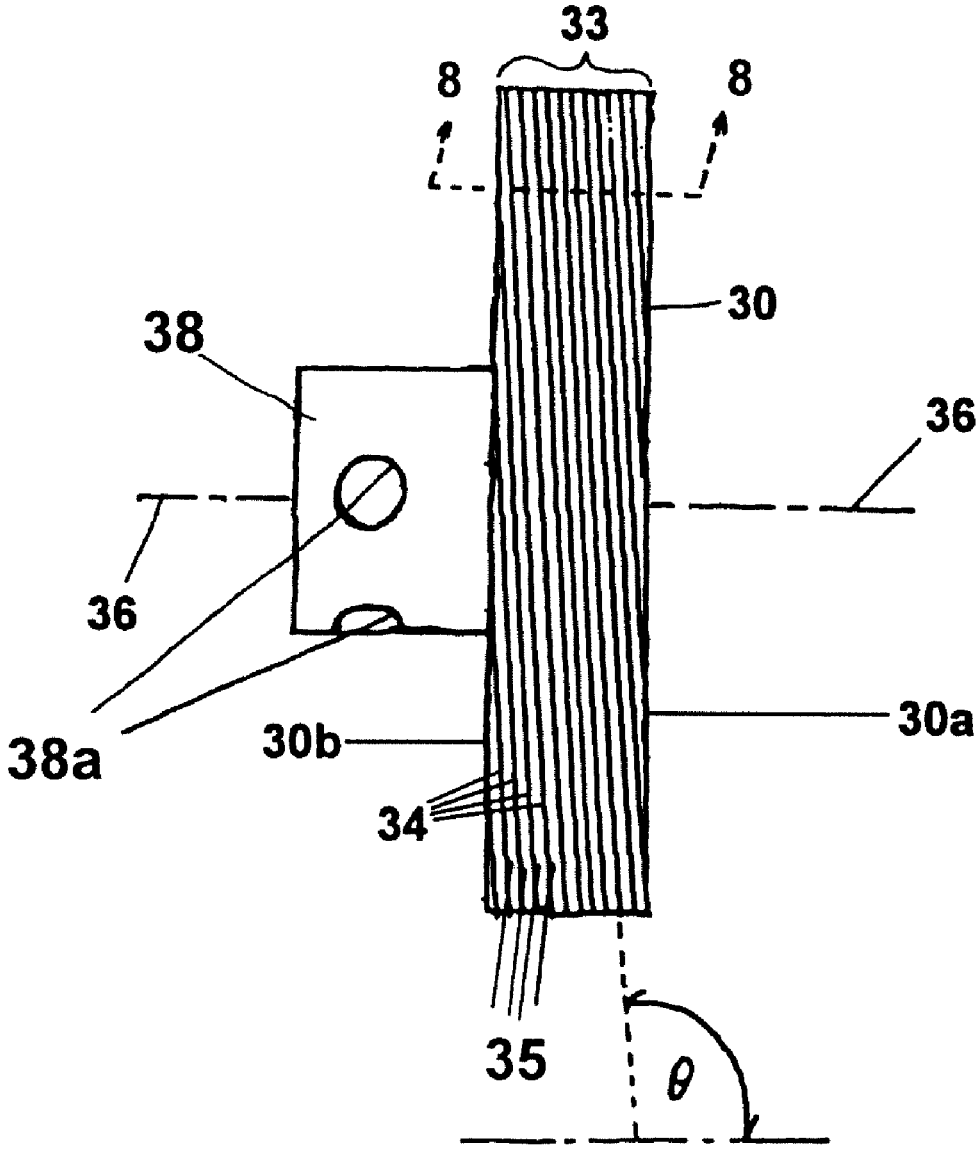
FIG. 7 is a plan view of components of an embodiment of an apparatus in accordance with the present invention.

As shown in the side plan view of FIG. 7, the corrugating wheel 30 can be non-rotatably connected to a mounting fixture 38 that has an axial opening that extends through the fixture 38 in a direction parallel to the rotational axis 36. The mounting fixture 38 is configured to receive therein one end of the axial shaft 31. At least a pair of threaded holes 38*a*, desirably one at a ninety degree orientation from the other, is drilled radially into the mounting fixture 38. Each hole 38*a* is configured to receive therein a set screw to fix the axial shaft 31 (not shown in FIG. 7) non-rotatably in the mounting fixture 38.

In an alternative embodiment, the motor 40 and gearing arrangement with the cogged pulleys 51, 52 and the cogged drive belt 53 can be replaced by a precision geared motor wherein direct drive gears are integrated with the armature shaft of the motor and provide an output shaft on which the corrugating wheel 30 can be directly mounted.

As schematically shown in FIG. 7, for example, the corrugating wheel 30 desirably is provided with an annular cylindrical surface that forms a circumferential edge, which is schematically indicated by the designation 33. As schematically shown by the parallel diagonal lines (the angle theta indicative of the angle relative to the axis 36 of rotation, being exaggerated for purpose of illustration) in FIG. 7, a corrugating surface is defined in the annular circumferential edge 33 of the corrugating wheel 30. In the plan view schematically shown in FIG. 7, each diagonal line (the line thickness and spacing between lines not being drawn to scale) schematically represents the sharp point of a peak 34 that is more easily seen in the cross-sectional view of FIG. 8.

Figure 8:
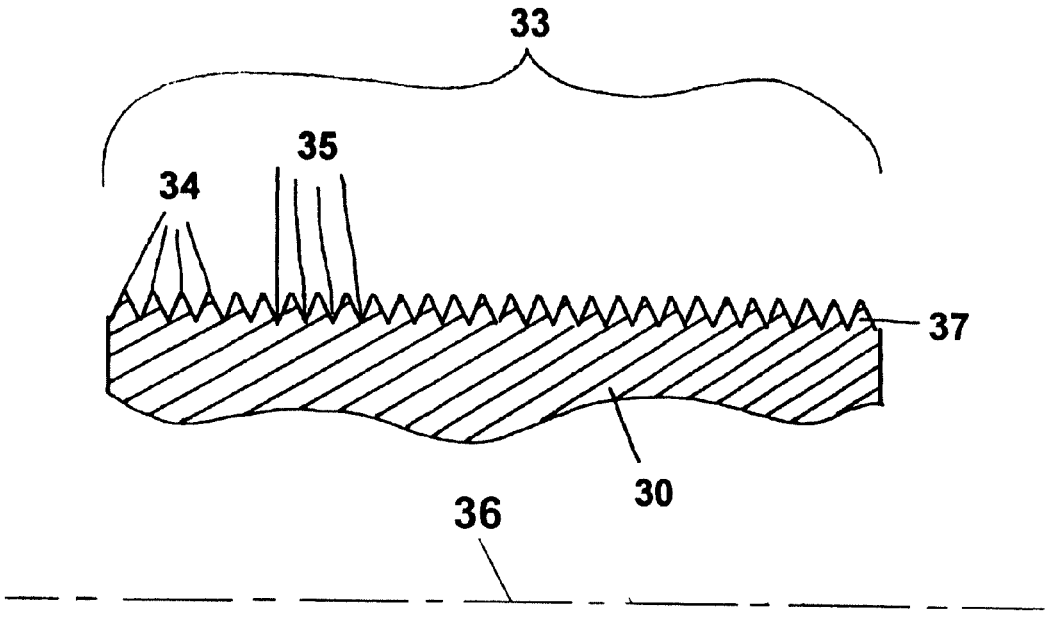
FIG. 8 is a cross-sectional view taken along the line of arrows 8-8 in FIG. 7.

As schematically shown in FIG. 8, taken together, the triangular shaped cross-sectional structures underlying the peaks 34 resemble a row of teeth 37 that projects radially from the corrugating wheel 30 and defines any axial line drawn through the annular circumferential edge 33 of the corrugating wheel 30. As shown in the schematic cross-sectional representation of FIG. 8, defined between the adjacent teeth 37 forming the adjacent peaks 34 is a groove 35. As shown in FIG. 8, the grooves 35 resemble valleys 39 that are triangular in shape and recessed into the annular circumferential edge 33 of the corrugating wheel 30. Thus, in any line taken in a direction parallel to the axis 36 of rotation and across substantially the entire axial width of the corrugating surface, the corrugating surface defines a plurality of alternating peaks 34 and grooves 35.

Though resembling teeth 37 when viewed in cross-section as in FIG. 8, these structures desirably are actually formed by one long, substantially uninterrupted ridge that helically winds around the entire circumferential edge 33 of the corrugating wheel 30 as the threads of a bolt. Similarly the spaces separating adjacent sections of the helical ridge desirably are formed by one long, substantially uninterrupted recess that helically winds around the entire circumferential edge 33 of the corrugating wheel 30. Thus, as schematically shown in FIG. 7, the plurality of parallel alternating peaks 34 and grooves 35 desirably forms part of a continuous, helically shaped pattern of alternating peaks 34 and grooves 35 defined in the entire annular circumferential edge of the corrugating wheel 30. This helically shaped pattern of alternating peaks 34 and grooves 35 defined in the entire annular circumferential edge 33 of the wheel 30 is therefore provided with a predetermined pitch. Depending upon the types of corrugations to be made by the corrugating wheel 30, the pitch desirably can fall within a range of from about 48 grooves per inch to about 100 grooves per inch. As schematically shown in FIGS. 4 and 6, the corrugating wheel 30 is mounted so as to be rotated in the direction of the arrow designated by the numeral 43, and in this configuration the pitch of the ridges 34 in the corrugating surface 33 desirably are oriented as a left-handed thread.

The corrugating surface of the corrugating wheel 30 is formed in the annular circumferential cylindrical edge 33 of the disc that forms the corrugating wheel 30. The corrugating wheel 30 desirably is formed of a circular disc formed of standard tool steel or any other material that can cut steel. As schematically shown in FIG. 7, such a steel corrugating wheel 30 desirably is on the order of 3¾ inches in diameter. As schematically shown in FIG. 7, any line taken in a direction parallel to the axis of rotation and across substantially the entire corrugating surface measures the width of the corrugating surface 33. As schematically shown in FIG. 3 for example, the width of the corrugating surface 33 measures substantially less than the length of the blade 13 of the scissors 14 that is to be corrugated. Desirably, the width of the entire corrugating surface 33 measures less than one quarter of the length of the blade 13 of the scissors 14 that is to be corrugated.

It has been found that a corrugating wheel 30 with a corrugating surface 33 having a substantially smaller width than the length of the blade 13 of the scissor 14 to be corrugated allows for greater operator control over the corrugating process. This greater control results in less damage to the corrugating surface 33 during use and fewer mishaps that damage the scissor blade 13 that is being corrugated. Moreover, the much smaller width of the corrugating surface 33 of the corrugating wheel 30 means less surface needs to be coated with the abrasive and allows for more economical manufacture of the device. Additionally, it has been found that portions of the wider corrugating surfaces of the prior art devices went unused, and yet the entire wheel had to be resurfaced once the portion being used became dulled with use, thereby identifying another inefficiency associated with the use of corrugating surfaces that had a width comparable to the length of the blade of scissors to be corrugated.

Desirably, as schematically shown in FIG. 7, the corrugating wheel 30 has a circumferential annular edge 33 having an axial thickness measuring about ¾ inches wide from the front 30*a* of the wheel 30 to the back 30*b* of the wheel 30, and desirably weighs about 2.6 pounds. In the three quarter inch wide corrugating surface 33 schematically shown in FIG. 7 and rotating at about 400 RPM, the pitch presently deemed most desirable can be about 72 grooves per inch. The diameter and axial thickness of the corrugating wheel 30 can vary to suit the type of scissor blade 13 that is to be corrugated. However, the axial thickness of the corrugating wheel 30 desirably is much smaller than the length of the blade that is to be corrugated by the wheel 30. Moreover, the raw steel disk that is fabricated into the final corrugating wheel 30 desirably starts the fabrication process with a larger diameter before undergoing various machining, honing, threading, electroplating and polishing processes.

The corrugating surface can be formed desirably by the circumferentially disposed peripheral annular edge 33 of a circular steel disc that has been coated with a fine diamond coating. In the case of a corrugating wheel 30 formed of steel, the diamond coating desirably is electroplated to the threaded annular edge of the wheel and then polished in order to form the final corrugated surface 33 of the corrugated wheel 30. The diamond coating that is electroplated onto the threaded circumferential edge 33 desirably has a particulate rating of about 400 grit with particulate sizes of the diamond dust on the order of about 50 microns to about 40 microns.

The corrugating surface also can be formed in the circumferentially disposed peripheral annular edge 33 of a circular steel disc that has been coated with a fine ceramic coating or a fine silicon carbide coating or a combination of a fine coating of ceramic particles and/or diamond particles and/or silicon carbide particles can be used. Alternatively, the corrugating surface can be formed by a threading machine in the circumferentially disposed peripheral annular surface of a circular disc formed of aluminum oxide (or a disc formed of any other material hard enough to cut steel) without any coating of abrasive particulate such as diamond or ceramic in a binder that adheres to the particulate to the metal.

In order to provide the annular circumferential edge 33 with the continuous, helically shaped ridge that produces the pattern of alternating peaks 34 and grooves 35, the edge 33 is machined smooth and round and then subjected to threading by a threading machine that cuts a predetermined number of individual threads per inch measured in the axial direction in the edge 33. Then the peaks 34 in the threaded surface are flattened a bit by being honed from a point to form a flat so that the diamond particulates (or other abrasive particulate coating) will properly adhere to the flat and form the peaks 34 that ultimately start the cutting when the corrugating wheel 30 is in use in the apparatus 20.

Alternatively, in a first alternative embodiment, the ridges 34 in the corrugating surface 33 of the corrugating wheel 30 could be formed by the circumferential edges of planes disposed parallel to each other and normal to planes that contain the axis of rotation 36 of the corrugating wheel 30. In a still further alternative embodiment, the ridges 34 could be formed by the circumferential edges of planes disposed parallel to each other and disposed at an angle to planes that contain the axis of rotation 36 of the corrugating wheel 30. In this latter embodiment, the formation of such angled parallel (as opposed to slightly helically pitched) ridges is difficult to accomplish because each section of the corrugating surface 33 must be done separately and precisely aligned with the prior section in order to keep each ridge parallel to the ridges to each opposite side.

In use, the apparatus 20 can perform a method for grinding corrugations into the cutting edge 12 of a blade of a pair of scissors 14 for which the cutting edge 12 of the blade 13 has been resharpened (and thereby having removed the original corrugations in the blade). The motor 40 is turned on and rotates the corrugating wheel 30 at essentially a constant number of revolutions per minute in the direction schematically indicated by the arrow 43 in FIGS. 4 and 6. As shown in FIG. 3 for example, a mechanical blade holder such as the clamping system 23 is used to hold the blade 13 to be corrugated at a fixed orientation with respect to the rotating corrugating surface 33 defined in the annular surface of the corrugating wheel 30. Desirably, to begin corrugating process, the edge 12 of the resharpened blade 13 that is to be corrugated is placed near the portion of the blade 13 that is closest to the pivot point 17 of the scissor 14. Then the blade 13 to be corrugated is placed into sufficient grinding contact with the corrugating surface 33 so that upon rotation of the corrugating wheel 30 with the corrugating surface 33 in contact with the edge 12 of the blade 13, the rotation of the corrugating wheel 30 will cause the blade 13 to be pulled in the direction such that the tip 16 at the free end of the blade 13 moves in the direction of the arrow 46 in FIG. 3. During this translation of the scissor blade 13 by the rotation of the corrugating wheel 30, the corrugating surface 33 of the corrugating wheel 30 will grind new corrugations into the entire edge 12 of the resharpened scissor blade 13. Such translational movement of the blade 13 during grinding of the corrugations corresponds to the tip 16 of the blade 13 moving ever closer toward the corrugating wheel 30 as the corrugating surface 33 of the corrugating wheel 30 grinds new corrugations 15 into the entire edge 12 of the resharpened scissor blade 13. Such translational movement of the blade 13 is caused by the screw-like action effected by the rotation of the helical pattern defined in the corrugating surface 33 in contact with the edge 12 of the blade 13. Such screw-like movement is achieved with the corrugating wheel 30 mounted so as to be rotated in the direction of the arrow designated by the numeral 43 as schematically shown in FIG. 4, and the pitch of the ridges 34 in the corrugating surface 33 oriented as a left-handed thread.

Grinding of the edge 12 of the scissor blade 13 by the corrugating surface 33 in the circumferential edge of the corrugating wheel 30 removes material from the edge 12 of the scissor blade 13 where the teeth 37 are located and leaves untouched the material from the edge 12 of the scissor blade 13 where the valleys 39 are located. As schematically shown in FIG. 2B, the removal of material from the edge 12 of the scissor blade leaves a score 15 in the edge 12*a* of the scissor blade 13. Thus, grinding of the resharpened edge 12 of the scissor blade 13 shown in FIGS. 1A and 1B by contact with the rotating corrugating surface 33 defined in the circumferential edge of the corrugating wheel 30 leaves a corrugated pattern of scores 15 in the edge 12*a* of the scissor blade 13 and produces a corrugated scissor blade 13 as shown in FIGS. 2A and 2B.

In accordance with the present invention, the axial thickness of the corrugating surface 33 of the corrugating wheel 30 is configured to be only a small fraction of the length of each blade 13 to be corrugated. For example, in order to provide fine corrugations on the cutting edge 12 of a scissor blade 13 measuring 3½ to 4 inches in length, a corrugating wheel 30 having a diameter of 3¾ inches desirably has an axial thickness of about three-quarters of an inch for the corrugating surface 33. The pitch of the ridges 34 on the corrugating surface 33 on the circumferential edge of the corrugating wheel 30 desirably is in a range that is on the order of about 48 threads per inch to about 100 threads per inch and preferably is about 72 threads per inch. A corrugating wheel 30 of the above-described dimensions that is provided with a pitch of about 72 threads per inch can corrugate a blade 13 measuring about four inches in length in about five seconds in a single translational movement of the blade 13 from the pivot point 17 to the tip 16. Because the present invention can use a corrugating wheel 30 that is configured to be only a small fraction of the length of the blade 13 to be corrugated, the expense of a larger corrugating wheel 30 is avoided, thereby making the device affordable for a wider range of end users that need to resharpen corrugated blades of scissors. Moreover, the present invention can be used to corrugate blades of different length without the need to change the corrugating wheel 30 to match the length of the sharpened blade that is to be corrugated.

With the above-described embodiment of the apparatus 20, the speed of rotation of the corrugating wheel 30 and the pitch of the corrugating surface on the circumferential edge 33 of the corrugating wheel 30 desirably are chosen so that the user can grind a corrugated edge 12*a* in a four inch scissor blade 13 in about five seconds with a single pass of the blade 13 against the corrugating surface 33 of the corrugating wheel 30. Coarser corrugations will require adjacent peaks 34 and grooves 35 in the corrugating surface 33 on the circumferential edge of the corrugating wheel 30 that are more widely spaced apart and deeper than the peaks 34 and grooves 35 for imposing smaller and more closely spaced apart scores 15 on the blade 13 of a corrugated scissor 14.

While at least one presently preferred embodiment of the invention has been described using specific terms, such description is for illustrative purposes only, and it is to be understood that changes and variations may be made without departing from the spirit or scope of the following claims.

What is claimed is:

1. A portable device for grinding corrugations into a narrow surface forming one side of the cutting edge of a blade of a pair of scissors for which the cutting edge of the blade has been resharpened, comprising:

a portable base;

a blade holder carried by said base and configured to support the blade to be corrugated;

a corrugating wheel carried by said base in a manner rotatable about an axis of rotation relative to said base and having an annular circumferential edge defining a corrugating surface therein, wherein any line taken in a direction parallel to the axis of rotation and across substantially the entire corrugating surface measures substantially less than the length of the blade of the scissors, and wherein said corrugating surface defines a plurality of alternating radially projecting, triangular shaped peaks and grooves;

an axial shaft carried by said base and nonrotatably connected to said corrugating wheel and having a central axis of rotation coincident with the axis of rotation of said corrugating wheel;

a motor carried by said base and having an armature configured to rotate at a first revolution per minute (RPM) rating; and a gearing arrangement carried by said base and connecting said rotatable armature of the motor to the axial shaft, said gearing arrangement being configured to convert the first RPM rating to a second RPM rating.

2. A device as in claim 1, wherein the entire corrugating surface measures less than one quarter of the length of the blade of the scissors to be corrugated.

3. A device as in claim 1, wherein the plurality of parallel alternating peaks and grooves forms part of a substantially continuous pattern that helically winds around substantially the entire annular circumferential edge of the corrugating wheel.

4. A device as in claim 3, wherein the helically shaped pattern of alternating peaks and grooves defined in the entire annular circumferential edge of the corrugating wheel has a predetermined pitch.

5. A device as in claim 4, wherein the predetermined pitch is the range of about 48 grooves per inch to about 72 grooves per inch.

6. A device as in claim 1, wherein the second RPM rating is less than the first RPM rating.

7. A device as in claim 1, wherein the corrugating wheel is formed of steel and the corrugating surface includes a diamond coating.

8. A device as in claim 7, wherein the diamond particulates used in the coating have a particulate rating of about 400 grit with particulate sizes on the order of about 50 microns to about 40 microns.

9. A device as in claim 1, wherein the corrugating wheel is formed of steel and the corrugating surface includes a ceramic coating.

10. A device as in claim 1, wherein the corrugating wheel is formed of aluminum oxide.

11. A device as in claim 1, further comprising:

a cover carried by said base and configured to cover the motor, the shaft, the gearing arrangement, the blade holder, and all but a small portion of the corrugating wheel, and said cover further defining a slot through which the small portion of the corrugating wheel protrudes through said cover.

12. A device as in claim 1, wherein the blade holder includes an adjustable clamp.

13. A device as in claim 1, wherein the motor is an electric motor.

14. A device as in claim 1, further comprising:

an arm arrangement including a plurality of pivotally connected links, a first end of the arm arrangement being carried by said base, a second end of the arm arrangement being connected to the blade holder wherein the arm arrangement is configured to permit continuous adjustment, during use of the device to grind corrugations, of the orientation of the blade holder relative to the axis of rotation of the corrugating wheel from the orientation of the blade holder being parallel to the axis of rotation of the corrugating wheel to the orientation of the blade holder being disposed at any acute angle relative to the axis of rotation of the corrugating wheel.

15. A device as in claim 1, further comprising a bearing block carried by said base and rotatably supporting the shaft.

16. A device as in claim 1, wherein the gearing arrangement includes a first cogged pulley non-rotatably connected to said armature of said motor, a second cogged pulley non-rotatably connected to said axial shaft and a cogged drive belt engaging each cogged pulley in a manner permitting the motor to drive rotation of the axial shaft connected to the corrugating wheel.

17. A method for grinding corrugations into a narrow surface forming one side of the cutting edge of a blade of a pair of scissors for which the cutting edge of the blade has been resharpened, comprising:

using a motor to rotate a portable corrugating wheel at essentially a constant number of revolutions per minute, wherein the annular circumferential edge of the wheel defines a corrugating surface therein, wherein the width of the corrugating surface measures substantially less than the length of the blade of the scissors and said corrugating surface defines a plurality of alternating radially projecting, triangular shaped peaks and grooves that has a predetermined pitch;

using a mechanical blade holder to hold the blade to be corrugated at a fixed angle with respect to the rotating corrugating surface of the corrugating wheel;

placing the edge of the resharpened blade near the portion of the blade closest to the pivot point of the scissor, into sufficient grinding contact with the corrugating surface so that upon rotation of the corrugating wheel with the corrugating surface in contact with the narrow surface forming one side of the edge of the blade to be corrugated, the rotation of the corrugating wheel will cause the free end of the blade to be pulled in the direction toward the corrugating surface of the corrugating wheel as the corrugating surface of the corrugating wheel will grind new corrugations into the entire narrow surface forming one side of the edge of the resharpened scissor blade.

* * * * *